US010203154B1

(12) United States Patent
Wyatt

(10) Patent No.: US 10,203,154 B1
(45) Date of Patent: Feb. 12, 2019

(54) LIGHTING ASSEMBLY AND COOLER SYSTEM

(71) Applicant: Christopher A. Wyatt, Brooksville, FL (US)

(72) Inventor: Christopher A. Wyatt, Brooksville, FL (US)

( * ) Notice: Subject to any disclaimer, the term of this patent is extended or adjusted under 35 U.S.C. 154(b) by 0 days.

(21) Appl. No.: 15/188,390

(22) Filed: Jun. 21, 2016

(51) Int. Cl.

| | |
|---|---|
| ***F25D 27/00*** | (2006.01) |
| ***F21V 23/04*** | (2006.01) |
| ***F21V 23/00*** | (2015.01) |
| ***F21V 23/02*** | (2006.01) |
| ***B65D 43/16*** | (2006.01) |
| ***F25D 3/06*** | (2006.01) |
| ***F25D 29/00*** | (2006.01) |

(52) U.S. Cl.
CPC ..... *F25D 27/005* (2013.01); *B65D 43/163* (2013.01); *F21V 23/001* (2013.01); *F21V 23/023* (2013.01); *F21V 23/04* (2013.01); *F25D 3/06* (2013.01); *F25D 29/003* (2013.01)

(58) Field of Classification Search
CPC ..... F25D 27/005; F25D 29/003; F25D 3/06; F21V 23/04; F21V 23/001; F21V 23/023; B65D 43/163
USPC .... 362/154, 155, 249.02, 362, 373, 264, 92, 362/94
See application file for complete search history.

(56) References Cited

U.S. PATENT DOCUMENTS

| | | | | |
|---|---|---|---|---|
| 7,722,204 | B1 * | 5/2010 | Sandberg | F25D 3/08 362/155 |
| 9,671,158 | B1 * | 6/2017 | Sandberg | F25D 27/005 |
| 2006/0279947 | A1 * | 12/2006 | Henley, Jr. | F25D 27/00 362/154 |
| 2007/0103895 | A1 * | 5/2007 | Riesebosch | F25D 27/00 362/154 |
| 2011/0026264 | A1 * | 2/2011 | Reed | F21V 29/004 362/373 |

* cited by examiner

*Primary Examiner* — Anh Mai
*Assistant Examiner* — Glenn Zimmerman

(57) ABSTRACT

A cooler has a rear, front, side walls, a bottom wall. The upper edges of the front, rear, and side walls form an upper periphery. A chamber is formed Between the front, rear, side, and bottom walls. A peripheral lighting assembly has an inverted U-shaped housing located above the upper periphery forming a passageway. A plurality of light emitting diodes have connecting wires. Each Light emitting diode has an inner section, an outer section, and a central section. The inner section of each light emitting diode is located within the passageway. A lid has an upper surface. The lid has a lower surface with a lower periphery. A hinge pivotally couples the lid to the cooler allowing movement between raised and lowered orientations. The lid is of a size and shape to rest in contact with the peripheral lighting assembly.

6 Claims, 3 Drawing Sheets

FIG. 6
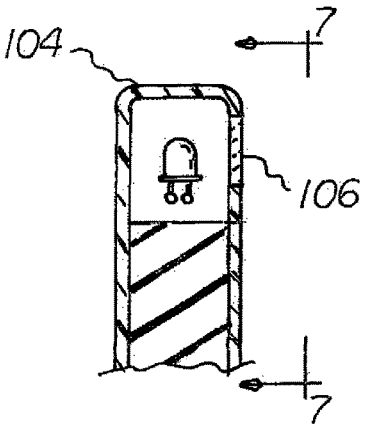
FIG. 7
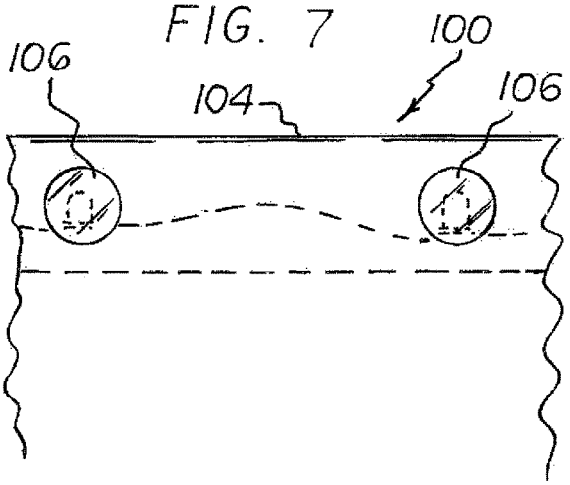
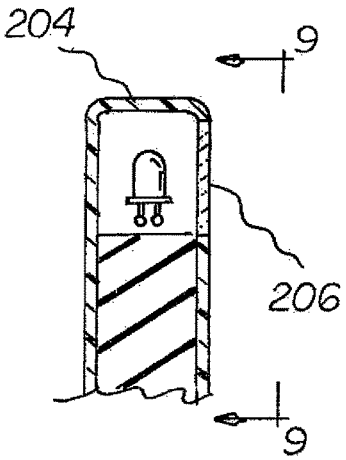
FIG. 8
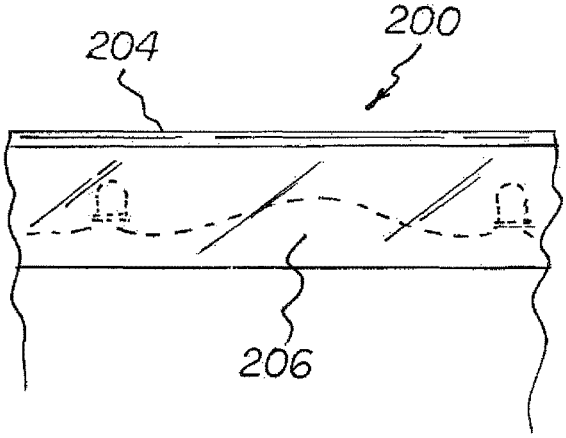
FIG. 9

LIGHTING ASSEMBLY AND COOLER SYSTEM

RELATED APPLICATION

The invention of the present patent application is an improvement over the invention of my prior patent application Ser. No. 10/823,303 filed Apr. 13, 2004, now U.S. Pat. No. 6,997,007 issued Feb. 14, 2006 which is based upon provisional application Ser. No. 60/463,224 filed Apr. 15, 2003.

BACKGROUND OF THE INVENTION

Field of the Invention

The present invention relates to a lighting assembly and cooler system and more particularly pertains to illuminating the contents of a cooler and for viewing of the contents of the cooler during dark conditions, the illuminating and the viewing being done in a safe, convenient, and economical manner.

SUMMARY OF THE INVENTION

In view of the foregoing disadvantages inherent in the known types of cooler systems of known designs and configurations now present in the prior art, the present invention provides an improved lighting assembly and cooler system. As such, the general purpose of the present invention, which will be described subsequently in greater detail, is to provide a new and improved lighting assembly and cooler system and method which has all the advantages of the prior art and none of the disadvantages.

From a broad viewpoint, the present invention is a lighting assembly and cooler system. First provided is a cooler. The cooler has a front, a rear, side walls, and a bottom wall. The front, rear, and side walls each have an upper edge. The upper edge forms a rectangular upper periphery. A chamber is formed between the front, rear, side, and bottom walls. A peripheral lighting assembly is provided. The peripheral lighting assembly includes an inverted U-shaped housing located above the rectangular upper periphery. The inverted U-shaped housing forms a rectangular passageway. A plurality of light emitting diodes are provided. The light emitting diodes have connecting wires. Each light emitting diode has an inner section, an outer section, and a central section. The inner section of each light emitting diode is located within the passageway. Further provided is a lid. The lid has an upper surface. The lid has a lower surface with a lower periphery. A hinge pivotally couples the lid to the cooler. In this manner movement between raised and lowered orientations is allowed. The lid is of a size and shape to rest in contact with the peripheral lighting assembly.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved lighting assembly and cooler system which has all of the advantages of the prior art cooler assemblies of known designs and configurations and none of the disadvantages.

It is another object of the present invention to provide a new and improved lighting assembly and cooler system which may be easily and efficiently manufactured and marketed.

It is a further object of the present invention to provide a new and improved lighting assembly and cooler system which is of durable and reliable constructions.

An even further object of the present invention is to provide a new and improved lighting assembly and cooler system which is susceptible of a low cost of manufacture with regard to both materials and labor, and which accordingly is then susceptible of low prices of sale to the consuming public, thereby making such lighting assembly and cooler system economically available to the buying public.

Lastly, another object of the present invention is to provide a lighting assembly and cooler system for illuminating the contents of a cooler and for viewing of the contents of the cooler during dark conditions, the illuminating and the viewing being done in a safe, convenient, and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 6 is a cross sectional view similar to FIG. 4 but illustrating an alternate embodiment of the invention.

FIG. 7 is a side elevational view taken along line 7-7 of FIG. 6.

FIG. 8 is a cross sectional view similar to FIGS. 4 and 6 but illustrating another alternate embodiment of the invention.

FIG. 9 is a side elevational view taken along line 9-9 of FIG. 8.

The same reference numerals refer to the same parts throughout the various Figures.

DESCRIPTION OF THE PREFERRED EMBODIMENT

Figure 1:
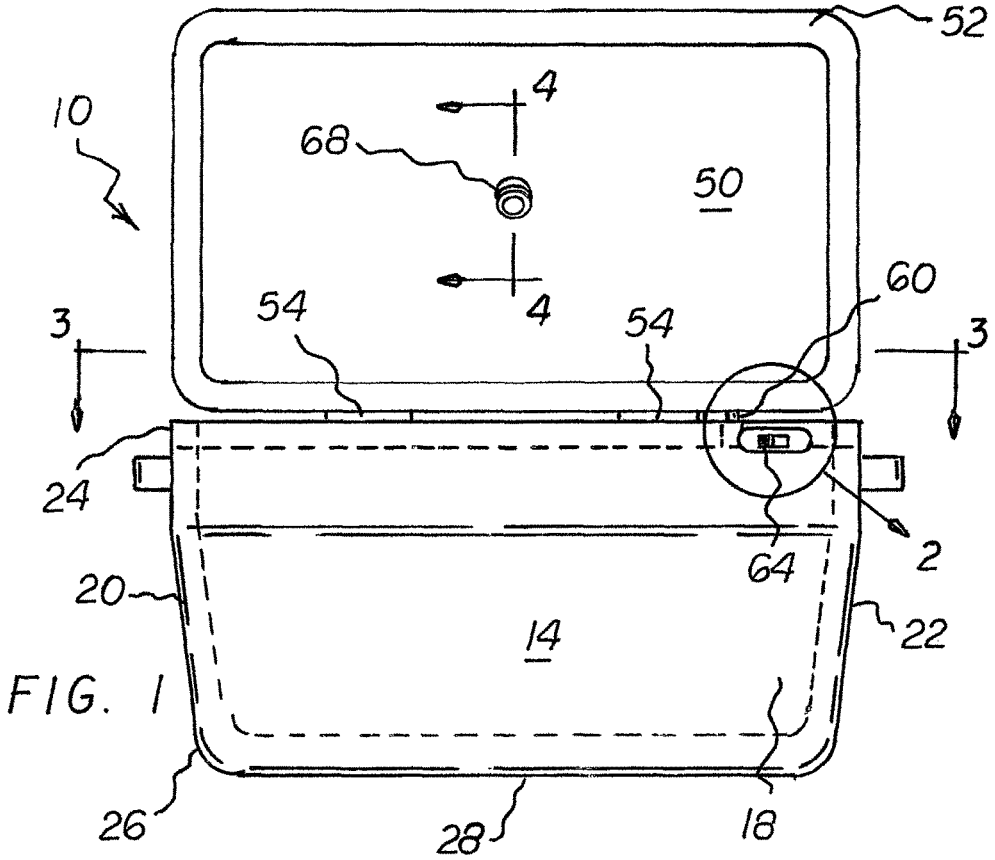
FIG. 1 is a front elevational view of a lighting assembly and cooler system constructed in accordance with the principles of the present invention.
Figure 2:
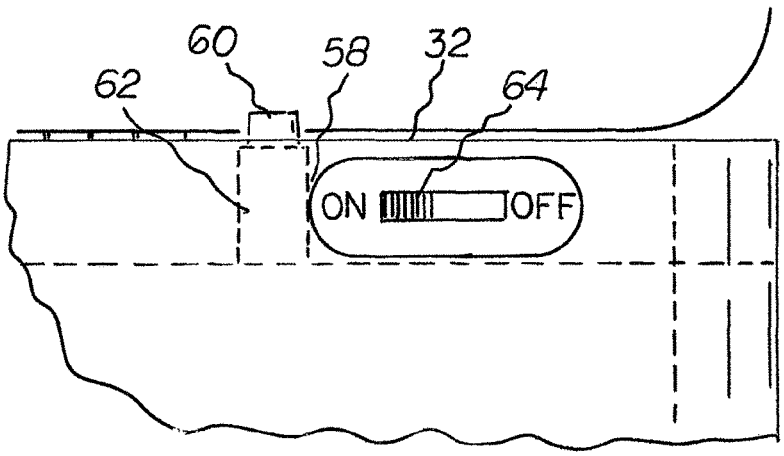
FIG. 2 is an enlarged front elevational view taken at circle 2 of FIG. 1.
Figure 3:
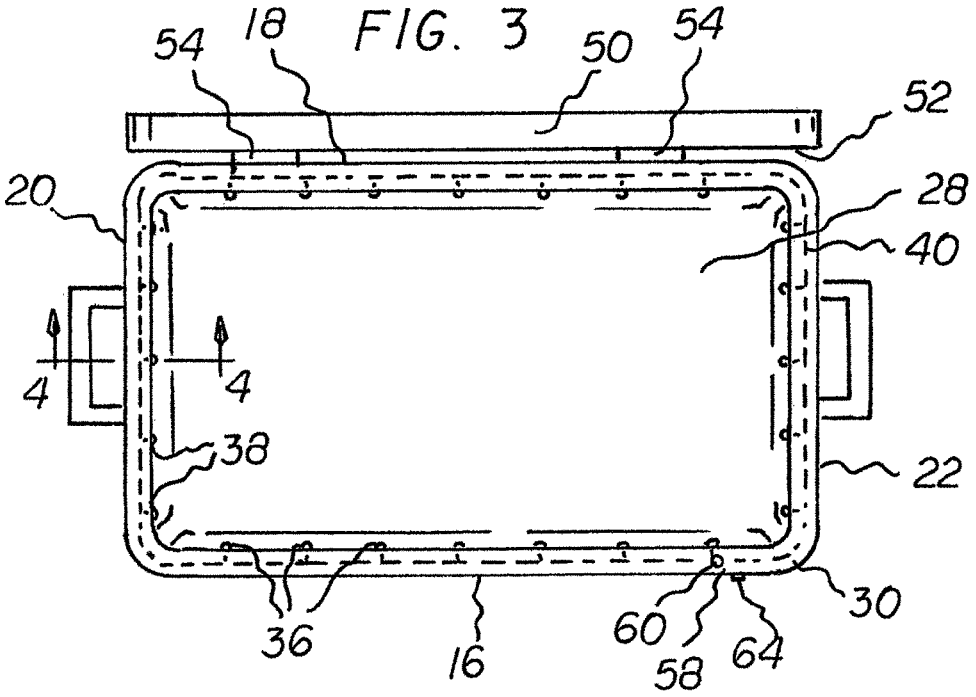
FIG. 3 is a cross sectional view taken along line 3-3 of FIG. 1.
Figure 4:
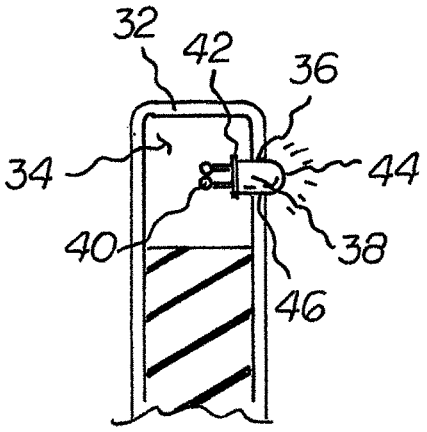
FIG. 4 is a cross sectional view taken along line 4-4 of FIG. 3.
Figure 5:
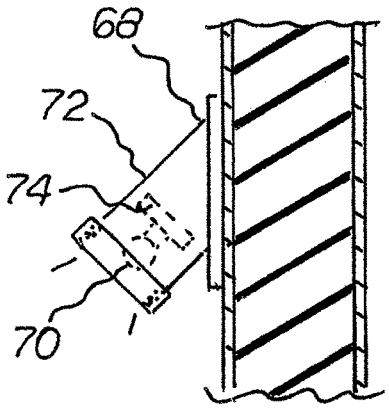
FIG. 5 is a cross sectional view taken along line 5-5 of FIG. 1.

With reference now to the drawings, and in particular to FIG. 1 thereof, the preferred embodiment of the new and improved lighting assembly and cooler system embodying the principles and concepts of the present invention and generally designated by the reference numeral 10 will be described.

The present invention, the lighting assembly and cooler system 10 is comprised of a plurality of components. Such components in their broadest context include a cooler, a peripheral lighting assembly, and a lid. Such components are individually configured and correlated with respect to each other so as to attain the desired objective.

From a specific viewpoint, the present invention is a lighting assembly and cooler system 10. First provided is cooler 14. The cooler has a front wall 16. The cooler has a rear wall 18. The cooler has two laterally spaced side walls 20, 22. The cooler has a bottom wall 28. The front and rear and side walls each have an upper edge 24. The front and rear and side walls each have a lower edge 26. The lower edges of the front and rear and side walls are coupled to the bottom wall. The upper edges of the front and rear and side walls form a rectangular upper periphery. The front and rear and side and bottom walls form a chamber.

A peripheral lighting assembly 30 is provided. The peripheral lighting assembly includes an inverted U-shaped housing 32. The inverted U-shaped housing is located above the rectangular upper periphery. In this manner a rectangular passageway 34 is formed. A plurality of holes 36 are provided. The holes are formed in the inverted U-shaped housing. The holes face the chamber. The peripheral lighting assembly includes a plurality of light emitting diodes 38. The peripheral lighting assembly includes wires 40. The wires couple together the light emitting diodes. Each light emitting diode has an inner section 42, an outer section 44, and a central section 46. The inner section of each light emitting diode is located within the passageway. The outer section of each light emitting diode is located outside of the passageway within the chamber. The central section of each light emitting diode is secured within an associated hole in the inverted U-shaped housing.

A lid 50 is provided. The lid has an upper surface. The lid has a lower surface. The lid has a lower periphery 52. A hinge 54 is provided. The hinge is pivotally couples the lid to the cooler. In a lowered orientation the lid is in contact with the inverted U-shaped housing. The lid is of a size and shape to rest in contact with the inverted U-shaped housing when in the lowered orientation. In a raised orientation, the lid is out of contact with the inverted U-shaped housing.

Further provided is a control assembly 58. The control assembly includes a button 60. The button extends upwardly from the inverted U-shaped housing adjacent to the front wall and a side wall. The lid is operable to depress the button and inactivate the lighting assembly while the lid is in the lowered orientation. The lid is further operable to release the button and activate the lighting assembly while the lid is in the raised orientation. The peripheral lighting assembly includes a source of electrical potential 62. Wires couple the light emitting diodes to each other. The wires further couple the light emitting diodes to the source of electrical potential. The control assembly also includes a switch 64. The switch extends outwardly from the inverted U-shaped housing adjacent to the front wall and a side wall. The switch is user controlled. The switch provides for movement between an ON orientation and an OFF orientation. When in the ON orientation, the button controls operation of the light emitting diodes. When in the OFF orientation, the light emitting diodes remain un-illuminated regardless of the orientation of the lid and the button.

Provided last is a supplemental light assembly 68. The supplemental light assembly includes a supplemental light emitting diode 70. The supplemental light assembly includes a tubular element 72. The tubular element has an exterior end and an interior end. The exterior end supports the supplemental light emitting diode. The interior end is secured to the lower surface of the lid. The tubular element has an axis at an angle from the lid. The tubular element and the axis face the bottom wall of the cooler when the lid is in the raised orientation. The tubular element faces the rear wall of the cooler when the lid is in the lowered orientation. The supplemental light assembly includes a battery 74. The battery is disk-shaped in configuration. The battery is between the supplemental light emitting diode and the lid. The battery powers the supplemental light emitting diode. The supplemental lighting assembly includes a transparent cap 76. The transparent cap is rotatably coupled to the tubular element at the exterior end. The transparent cap may be rotated in a first direction to illuminate the supplemental light emitting diode. The cap is further rotatable in a second direction to terminate the illumination of the supplemental light emitting diode is terminated.

In an alternate embodiment, the wires and the light emitting diode in the lighting assembly and cooler system 100 are located within the passageway. An inverted U-shaped housing 104 is provided. The inverted U-shaped housing is opaque. Transparent windows 106 are provided. The transparent windows face the chamber. In this manner the chamber is illuminated.

In another alternate embodiment the light emitting diodes of the lighting assembly and cooler system 200 are located within the passageway. An inverted U-shaped housing 204 is provided. The inverted U-shaped housing has a transparent surface 206. The transparent surface faces the chamber. In this manner, the chamber is illuminated.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A light assembly and cooler system comprising:

a cooler formed with front, rear, side, and bottom walls, the front, rear, and side walls each having an upper edge forming an upper periphery, the front, rear, side, and bottom walls forming a chamber there between;

a peripheral lighting assembly including an inverted U-shaped housing located above the upper periphery and forming a passageway, a plurality of light emitting diodes with connecting wires, each light emitting diode having an inner section and an outer section and a central section, the inner section of each light emitting diode being located within the passageway;

a lid having an upper surface and a lower surface with a lower periphery, a hinge pivotally coupling the lid to the cooler for movement between raised and lowered orientations, the lid being of a size and shape to rest in contact with the peripheral lighting assembly; and a supplemental light assembly comprising a supplemental light emitting diode and a tubular element having an exterior end and an interior end, the exterior end supporting the light emitting diode, the interior end secured to the lower surface of the lid, the tubular element having an axis at an angle from the lid, the tubular element and the axis facing the bottom wall of the cooler when the lid is in the raised orientation, the tubular element facing the rear wall of the cooler when the lid is in the lowered orientation, a battery in a disk-shaped configuration between the supplemental light emitting diode and the lid powering the supplemental light emitting diode, a transparent cap rotatably coupled to the tubular element at the exterior end, the cap being rotatable in a first direction to illuminate the supplemental light emitting diode, the cap rotatable in a second direction to terminate illumination of the supplemental light emitting diode.

2. The system as set forth in claim 1 and further including:

a control assembly including a button extending upwardly from the inverted U-shaped housing adjacent to the rear wall and a side wall, the lid operable to depress the button and inactivate the lighting assembly while the lid is in the lowered orientation, the control assembly including a switch for movement between an ON orientation and an OFF orientation, when in the ON orientation the button controlling the light emitting diodes, when in the OFF orientation the light emitting diode remaining un-illuminated regardless of the orientation of the lid and the button.

3. The system as set forth in claim 1 wherein the wires are located within the passageway.

4. The system (100) as set forth in claim 3 wherein the inverted U-shaped housing (104) is opaque with transparent windows (106) facing the chamber for illuminating the chamber.

5. The system (200) as set forth in claim 3 wherein the inverted U-shaped housing (204) has a transparent surface (206) facing the chamber for illumination purposes.

6. A light assembly and cooler system (10) for illuminating the contents of a cooler (14) and for viewing of the contents of the cooler during dark conditions, the illuminating and the viewing being done in a safe, convenient, and economical manner, the system comprising, in combination:

the cooler (14) formed with a front wall (16) and a rear wall (18) and two laterally spaced side walls (20), (22) there between, the cooler having a bottom wall (28), the front and rear and side walls each having an upper edge (24) and a lower edge (26), the lower edges of the front and rear and side walls coupled to the bottom wall, the upper edges of the front and rear and side walls forming a rectangular upper periphery, the front and rear and side and bottom walls forming a chamber there between;

a peripheral lighting assembly (30) including an inverted U-shaped housing (32) located above the rectangular upper periphery and forming a rectangular passageway (34), a plurality of hole (36) formed in the inverted U-shaped housing facing the chamber, the peripheral lighting assembly including a plurality of light emitting diodes (38), wires (40) coupling together the light emitting diodes, each light emitting diode having an inner section (42) and an outer section (44) and a central section (46), the inner section of each light emitting diode being located within the passageway, the outer section of each light emitting diode being located outside of the passageway within the chamber, the central section of each light emitting diode being secured within an associated hole in the inverted U-shaped housing;

a lid (50) having an upper surface and a lower surface with a lower periphery (52), a hinge (54) pivotally coupling the lid to the cooler, the lid having a lowered orientation in contact with the inverted U-shaped housing, the lid being of a size and shape to rest in contact with the inverted U-shaped housing when in the lowered orientation, the system having a raised orientation with the lid out of contact with the inverted U-shaped housing;

a control assembly (58) including a button (60) extending upwardly from the inverted U-shaped housing adjacent to the front wall and a side wall, the lid operable to depress the button and inactivate the lighting assembly while the lid is in the lowered orientation, the lid operable to release the button and activate the lighting assembly while the lid is in the raised orientation, the peripheral lighting assembly including a source of electrical potential (62), wires coupling the light emitting diodes to each other and to the source of electrical potential, the control assembly also including a switch (64) extending outwardly from the inverted U-shaped housing adjacent to the front wall and a side wall, the switch being user controlled for movement between an ON orientation and an OFF orientation, when in the ON orientation the button controlling operation of the light emitting diodes, when in the OFF orientation the light emitting diode remaining un-illuminated regardless of the orientation of the lid and the button; and a supplemental light assembly (68) comprising a supplemental light emitting diode (70) and a tubular element (72), the tubular element having an exterior end and an interior end, the exterior end supporting the supplemental light emitting diode, the interior end secured to the lower surface of the lid, the tubular element having an axis at an angle from the lid, the tubular element and the axis facing the bottom wall of the cooler when the lid is in the raised orientation, the tubular element facing the rear wall of the cooler when the lid is in the lowered orientation, a battery (74) in a disk-shaped configuration between the supplemental light emitting diode and the lid, the battery powering the supplemental light emitting diode, transparent cap (76) rotatably coupled to the tubular element at the exterior end rotatable in a first direction to illuminate the supplemental light emitting diode, the cap rotatable in a second direction to terminate illumination of the supplemental light emitting diode.

* * * * *